United States Patent [19]

Piramoon et al.

[11] 4,391,597

[45] Jul. 5, 1983

[54] HANGER FOR CENTRIFUGE BUCKETS

[75] Inventors: Alireza Piramoon, Santa Clara; Rebecca J. Woodruff, San Mateo, both of Calif.

[73] Assignee: Beckman Instruments, Inc., Fullerton, Calif.

[21] Appl. No.: 400,528

[22] Filed: Jul. 21, 1982

Related U.S. Application Data

[63] Continuation of Ser. No. 277,800, Jun. 29, 1981, abandoned.

[51] Int. Cl.[3] ..... B04B 9/12

[52] U.S. Cl. ..... 494/20

[58] Field of Search ..... 494/16, 20, 21; 74/53

[56] References Cited

U.S. PATENT DOCUMENTS

| | | | |
|---|---|---|---|
| 3,393,864 | 7/1968 | Galasso | 494/20 |
| 3,935,995 | 2/1976 | Williams | 494/20 |
| 3,993,018 | 11/1976 | Kranik | 494/20 |
| 4,093,118 | 6/1978 | Sinn et al. | 233/26 |
| 4,190,195 | 2/1980 | Chulay | 494/20 |

*Primary Examiner*—Robert W. Jenkins

*Attorney, Agent, or Firm*—R. J. Steinmeyer; F. L. Mehlhoff; Al A. Canzoneri

[57] ABSTRACT

A centrifuge rotor is provided which has a circumferential wall and a plurality of spaced arms which radiate outward from the center to the circumferential wall. A plurality of buckets are mounted on the rotor, one between each arm. Each bucket has two outwardly extending pivot pins situated on a common axis. A plurality of hangers are mounted in the spaced arms of the rotor. Each hanger comprises an elongated housing containing an opening which is transverse to the longitudinal dimension of the housing for receiving the pivot pin of a bucket. A longitudinal bore intersects the opening and contains a spring for exerting a clamping force on the pivot pin when the rotor is stopped. This prevents the bucket from rocking when being loaded or unloaded, but does not prevent the bucket from pivoting to a horizontal position when the rotor is rotating, nor does it prevent the bucket from resuming a vertical position when the rotor is stopped. The opening in the hanger for receiving the pivot pin of a bucket is intersected by an elongated longitudinal slot. The pivot pin is movable in this slot when the centrifugal force acting on both the bucket and the pin overcomes the clamping force of the spring. This movement of the pivot pin enables the bucket to be extended radially outward, so that it engages the centrifugal wall of the rotor.

1 Claim, 3 Drawing Figures

HANGER FOR CENTRIFUGE BUCKETS

This application is a continuation of application Ser. No. 277,800, filed June 29, 1981, now abandoned.

BACKGROUND OF THE INVENTION

The present invention relates to centrifuges, and more particularly to apparatus for supporting the buckets of a swinging bucket centrifuge rotor.

A swinging bucket centrifuge typically includes a rotor and a plurality of buckets supported by hangers that enable the buckets to pivot about their mounting axes. When the rotor is stopped, the buckets hang vertically downward under the influence of gravity. When the rotor is spinning, the buckets swing outward in reponse to centrifugal force to a horizontal position.

In a number of designs, the hanger incorporates some means to enable limited radial movement of the buckets when the rotor is spinning. This is so the bucket can become engaged with a portion of the rotor to gain support against the centrifugal force acting on it. Thus, with the load transferred to the rotor, the hangers are relieved of the burden of withstanding the heavy G force being exerted on the buckets. An obvious benefit of such an arrangement is that the hangers can be made smaller and lighter, and the rotor can be made more compact and inexpensively.

In U.S. Pat. No. 4,093,118 issued to Sinn et al. there is disclosed a centrifuge having buckets pivotally mounted to a rotor. The pivot axis of each bucket is movable along a guide track so that upon pivoting deflection, the buckets bear against a circumferential ring portion of the rotor. A possible disadvantage of this design is that it makes no provision for rapid detachment of the bucket from the rotor. This precludes operation with preloaded interchangeable buckets such as is practiced in production laboratories.

Another disadvantage of the disclosed design is that the buckets are prone to rock about their pivots, so that during loading and unloading operations, the operator must use one hand to hold the bucket steady.

Accordingly, the present invention is directed to a hanger device for use in the rotor of a centrifuge which overcomes the problems of the prior art.

SUMMARY OF THE INVENTION

In accordance with a preferred embodiment of the invention, a centrifuge rotor is constructed having an axis of rotation, a circumferential wall and a plurality of spaced arms which radiate from the axis of rotation to the circumferential wall. A plurality of buckets are mounted on the rotor, one between each arm. Each bucket has two outwardly extending pivot pins situated on a common axis. A plurality of hangers are mounted in the spaced arms of the rotor. Each hanger comprises an elongated housing containing an opening which is transverse to its longitudinal dimension for receiving the pivot pin of a bucket. A longitudinal bore intersects the opening and contains spring means for exerting a clamping force on the pivot pin when the rotor is stopped. This prevents the bucket from rocking when being loaded or unloaded, but does not prevent the bucket from pivoting to a horizontal position when the rotor is rotating, nor does it prevent the bucket from resuming a vertical position when the rotor is stopped.

The opening in the hanger for receiving the pivot pin of a bucket is intersected by an elongated longitudinal slot. The pivot pin is movable in this slot when the centrifugal force acting on the bucket and the pin overcomes the clamping force of the spring means. This movement of the pivot pin results in the bucket being extended radially outward, so that it engages the circumferential wall of the rotor.

DETAILED DESCRIPTION

Figure 1:
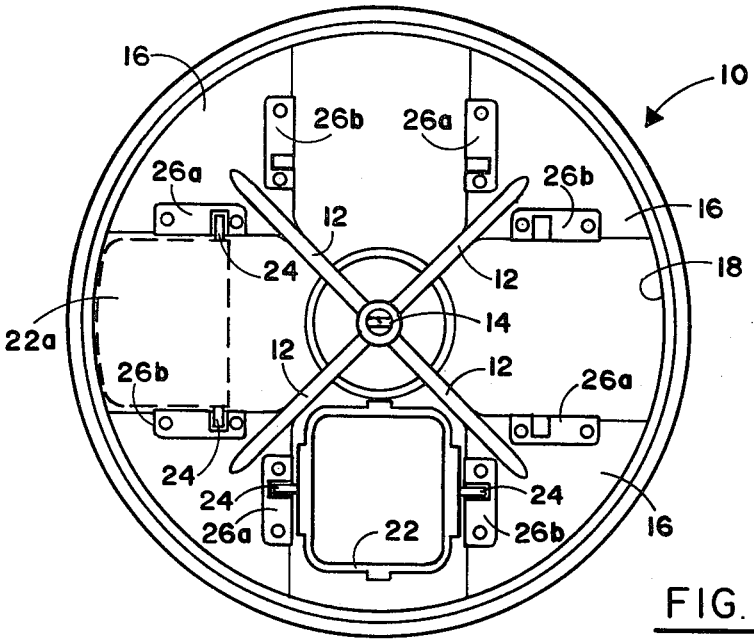
FIG. 1 is a plan view of a centrifuge rotor embodying the features of the invention.

There is shown in FIG. 1 a centrifuge rotor 10 including a plurality of spaced arms 12 which radiate outward from a center member 14 like the spokes of a wheel. The outward end of each arm 12 terminates in a triangular shaped extension 16 which is connected to the circumferential wall 18. A plurality of buckets 22, one of which is shown, are mounted to the rotor 10, disposed one between each arm 12. Each bucket 22 has two outwardly extending pivot pins 24 on a common axis. The pivot pins 24 engage hangers **26*a* and 26*b* mounted to the rotor 10, one on each arm extension 16 on opposite sides of the bucket 22. The hanger is provided with mounting holes 48 by which it is secured to the rotor by means of suitable fasteners such as rivets or screws. It will be seen that the hangers 26*a* are adapted for mounting on the left side of a bucket 22 and hangers 26*b* are adapted for mounting on the right side of a bucket 22. When the centrifuge is at rest, the buckets hang vertically downward as shown by the bucket 22** depicted in solid lines.

Figure 2:
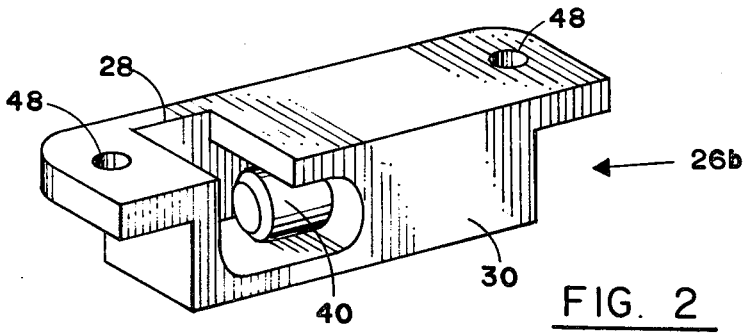
FIG. 2 is a perspective view of the hanger of the invention.
Figure 3:
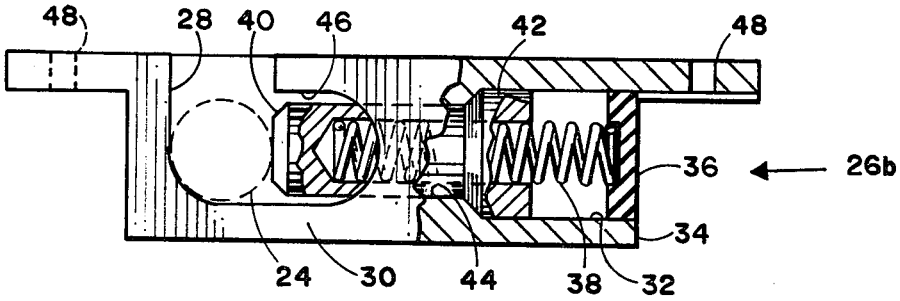
FIG. 3 is a cross-sectional view of the hanger of the invention.

Referring now to FIGS. 2 and 3, there is shown in greater detail a hanger **26*b*. Although the hanger illustrated is adapted for right side mounting with respect to a bucket, it is otherwise representative of hangers adapted for left side mounting. The hanger 26*a* comprises an elongated housing 30 which includes an opening 28 for receiving a pivot pin 24, and lies transverse to the longitudinal dimension of the housing 30. A longitudinal bore 32 extends from the end 34 of housing 30 to intersect with opening 28. The bore 32 at end 34 is closed by end cap 36. A coil spring 38 is disposed between the end cap 36 and a plunger 40. The plunger 40 is made captive by a flange 42 which abuts a shoulder 44 in the bore 32. It will also be noted that the opening 28 is intersected at right angles by an elongated slot 46**.

Thus, when the centrifuge is at rest, the plunger 40 being urged by the spring coil 38 protrudes into the opening 28 and exerts a force on the pivot pin 24. This force clamps the pin against the wall of the opening 28 and friction thereby inhibits free rotation of the pin. The effect of this process, which is duplicated by the counterpart hanger on the left side of the bucket, is to prevent the bucket rocking when being loaded and unloaded. This feature frees the operator of having to hold the bucket during these operations, and also enables him to easily install or remove a bucket from the rotor without involving any disassembly operations. It should be understood that the clamping force applied to the pivot pin does not prevent the bucket from pivoting to a horizontal position during operation or from resuming a vertical position upon coming to a stop.

Referring again to FIG. 1, there is shown in phantom line the orientation of the buckets 22*a* when the centrifuge is operating. It will be noted that the buckets 22*a* pivot to a horizontal position under the influence of centrifugal force. The centrifugal force acting on a bucket is transmitted by the pivot pin 24 to the plunger 40 and overcomes the force being exerted by the spring 38. Therefore, the pivot pin moves in the slot 46 in a direction outward of the axis of rotation, and, as a result of this movement, the base of the bucket is brought into contact with the circumferential wall 18 of the rotor 10. This contact transfers the load force from the pivot pin to the rotor, thus relieving the pivot pin, the hanger and arms of the rotor of the task of supporting the bucket against heavy centrifugal forces. Accordingly, the size and weight of the pivot pin, hangers and rotor arms can be reduced with corresponding benefits in reduced cost.

This also permits the buckets to be located closer to the axis of rotation, because the space between the arms is greater than that found in conventional rotors. That is, since the arms can be made thinner, the space therebetween becomes greater, permitting the buckets to be mounted closer to the spin axis. The result of this is to permit a reduction in the overall diameter of the rotor while retaining a given bucket size.

While in accordance with the patent statutes there has been described what at present is considered to be the preferred embodiment of the invention, it will be understood by those skilled in the art that various changes and modifications may be made therein without departing from the invention and it is, therefore, the aim of the appended claims to cover all such changes and modifications as fall within the true spirit and scope of the invention.

What is claimed is:

1. In a centrifuge rotor having an axis of rotation, a circumferential wall, a plurality of spaced arms radiating from said axis of rotation and supporting said circumferential wall, a plurality of buckets mounted one between each arm of said rotor, each said bucket having two outwardly extending pivot pins on a common axis, said pivot pins each engaging a hanger mounted on said rotor, said hanger comprising:

an elongated housing having mounting holes;

said housing having an opening transverse of its longitudinal axis for receiving a pivot pin of a bucket;

said housing having a longitudinal bore intersecting said opening;

said longitudinal bore having a counterbore forming a shoulder in said longitudinal bore;

a plunger slidably disposed in said longitudinal bore;

a spring disposed in said longitudinal bore, said spring acting on said plunger and urging said plunger in the direction of said opening for receiving said pivot pin;

said plunger having a flange, said flange abutting said shoulder of said longitudinal bore when said plunger is at the extreme end of its sliding travel, thereby retaining said plunger captive in said longitudinal bore;

said plunger exerting a clamping force on said pivot pin when said rotor is at rest preventing said bucket from rocking when being loaded or unloaded, but not preventing said bucket from pivoting to a horizontal position when said rotor is rotating, and not preventing said bucket from resuming a vertical position when said rotor is stopped;

an elongated slot intersecting said opening of said hanger at right angles, said pivot pin movable in said slot when centrifugal force acting on said bucket and said pin overcomes said clamping force, and movement of said bucket and said pin resulting in said bucket being extended radially outward and engaging said circumferential wall of said rotor.

* * * * *